US007815190B1

(12) United States Patent
Krisch et al.

(10) Patent No.: US 7,815,190 B1
(45) Date of Patent: Oct. 19, 2010

(54) COMPUTER PRINTABLE JIGSAW PUZZLE

(76) Inventors: Robert F. Krisch, 166-31 9th Ave., Bldg. 20, Studio 4A, Beechhurst, NY (US) 11357; Richard Hinchey, 44 Van Arsdale Pl., Manhasset, NY (US) 11030

( * ) Notice: Subject to any disclaimer, the term of this patent is extended or adjusted under 35 U.S.C. 154(b) by 360 days.

(21) Appl. No.: 11/757,974

(22) Filed: Jun. 4, 2007

Related U.S. Application Data

(60) Provisional application No. 60/803,830, filed on Jun. 2, 2006.

(51) Int. Cl.
*A63F 9/10* (2006.01)

(52) U.S. Cl. ..... 273/157 R

(58) Field of Classification Search ..... 273/157 R, 273/153 R

See application file for complete search history.

(56) References Cited

U.S. PATENT DOCUMENTS

| | | | | | |
|---|---|---|---|---|---|
| 1,948,962 | A * | 2/1934 | Decker | 273/157 R |
| 3,677,399 | A * | 7/1972 | Tatar | 273/157 R |
| 3,865,382 | A * | 2/1975 | Myller | 273/157 R |
| 5,158,295 | A * | 10/1992 | Shilling | 273/157 R |
| 5,232,088 | A * | 8/1993 | Leondidis | 206/223 |
| 5,368,301 | A * | 11/1994 | Mitchell | 273/157 R |
| 5,865,928 | A * | 2/1999 | Lariviere et al. | 156/256 |
| 5,988,687 | A * | 11/1999 | Krisch | 273/157 R |
| 6,086,067 | A * | 7/2000 | Benoit et al. | 273/157 R |
| 6,139,938 | A * | 10/2000 | Lingle et al. | 428/182 |
| 6,213,465 | B1 * | 4/2001 | Jacoby | 273/157 R |
| 6,336,631 | B1 * | 1/2002 | Volkert | 273/157 R |
| 6,663,732 | B1 * | 12/2003 | Link | 273/157 R |
| 7,510,187 | B2 * | 3/2009 | Haag | 273/157 R |
| 2002/0043760 | A1 * | 4/2002 | Gallant | 273/157 R |
| 2003/0067114 | A1 * | 4/2003 | Morioka | 273/157 R |
| 2003/0228449 | A1 * | 12/2003 | Robins et al. | 428/182 |
| 2009/0080028 | A1 * | 3/2009 | Gallant | 358/3.29 |

OTHER PUBLICATIONS

Author: Krisch, Robert; title: Puzzle Clonzz; items: Computer Printable Jigsaw Puzzles, Packaging: "Puzzle Clonzz 8", inserts: "Imprinting Tips", "Enhance . . . ", "Instructions"; date 1998; pages: all except insert entitled "Creative Advertising Themes"; publisher: Compoz-A-Puzzle, Inc.; Glen Head, NY, US.

Balsamo, Clark, title of the article: Make Your Own Jigsaw Puzzle, title of the item: website showing puzzle; date: unknown but purported to be 2002; pages: http://www.tdcgames.com/myopuzzle.htm http://www.tdcgames.com/factsht03.htm publisher: TDC Games; city and/or country where published: Itaska, IL, US.

Author: Creative Assembly Inc.; title: Make Your Own Jigsaw Puzzle, Publishing Guide; items: puzzle, 8 page instruction booklet for puzzle; date: unknown but purported to be 2002 by http://www.tdcgames.com/factsht03.htm pp. 2, 4, 5; Publisher: TDC Games Inc., Itaska, IL, US.

* cited by examiner

*Primary Examiner*—Steven Wong
(74) *Attorney, Agent, or Firm*—Nolte, Nolte & Hunter; Christopher B. Garvey

(57) ABSTRACT

A jigsaw puzzle has a blank and computer-printable face. The jigsaw puzzle has a thick substrate which forms a thick substrate sheet. The thick substrate sheet has been die-cut, into thick puzzle pieces. The thick puzzle pieces are joined together by uncut lands between the thick puzzle pieces. The cuts and said lands are in such proportions as to allow users to separate the thick puzzle pieces from each other. The thick substrate is at least 0.020" thick.

3 Claims, 5 Drawing Sheets

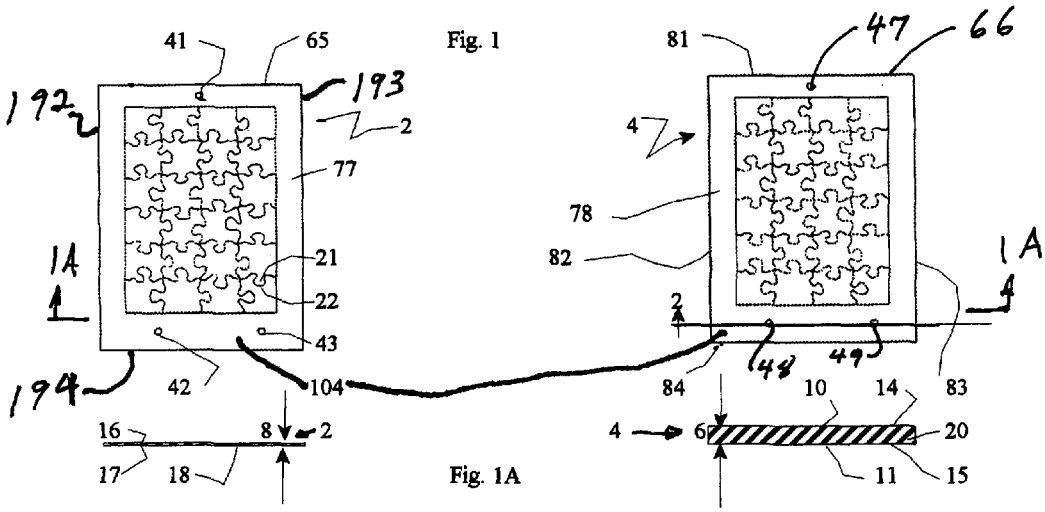
Fig. 1
Fig. 1A
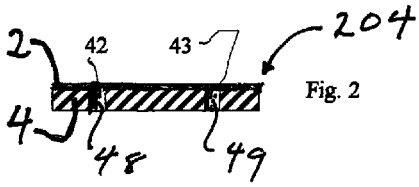
Fig. 2
Fig. 3
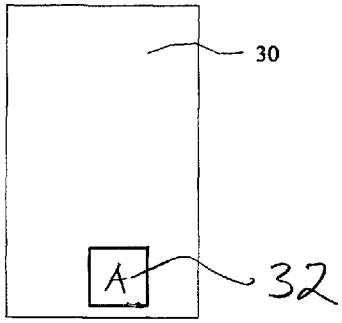
Fig. 4
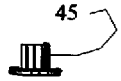

COMPUTER PRINTABLE JIGSAW PUZZLE

This application takes priority from Provisional Application 60/803,830, filed Jun. 2, 2006.

Not federally funded.

No microfiche appendix.

BACKGROUND OF THE INVENTION

1. Field of Invention

The present invention relates to jigsaw puzzles.

2. Description of the Related Art

One of the present co-inventors was awarded U.S. Pat. No. 5,988,687 on Nov. 23, 1999 for a Computer Printable Jigsaw Puzzle. That disclosure is incorporated herein by reference.

A later reference may be found at http://www.tdcgames.com/myopuzzle.htm

TDC Games claims to have developed a puzzle in 2002, see 2002 *Make Your Own Jigsaw Puzzle*, Balsamo, Clark;

http://www.tdcgames.com/factsht03.htm

The creation of our computer printable jigsaw Puzzle Cl ōnzz® was a project long in the making, before we actually received a utility patent back in 1999. Seven years have passed since that original patent was issued for the C.A.P. version of computer printable jigsaw Puzzle Clōnzz®. During this time we have desired to make a thicker substrate (thickness) board, to be used with the invention of the Krisch '687 patent.

However, if a thicker jigsaw puzzle evolved, it would exceed the maximum caliper allowances of most desktop printers . . . and the resultant product would be too rigid to traverse such printers' feed rollers.

Since 1999 there has been a movement in the digital printing field for the creation of machinery for the seamless imprinting of heavier and/or larger substrates. Large/wide format printers are now available for the printing of billboards, point of purchase displays, posters, etc. . . . on paper, showcard, wood, rubber, glass, etc., up to 1, 2, 3 inches thick. Desktop ink jets are now coming into fashion, as well, enabling rigid substrates to be printed under one's own roof, on one's own tabletop printing equipment. Epson, for example, has introduced photo quality ink-jets with straight through paper paths, accepting thicker media.

BRIEF DESCRIPTION OF THE DRAWINGS

FIG. 1 is a plan view of a thin and a thick puzzle.

FIG. 1A is an elevation thereof, sectioned through plane 1A of FIG. 1.

FIG. 2 is an elevation of the thin puzzle atop the thick puzzle, sectioned through plane 2 of FIG. 1.

FIG. 3 is a plan view of the package.

FIG. 4 is an elevation of a registration pin.

DETAILED DESCRIPTION

Figure 5:
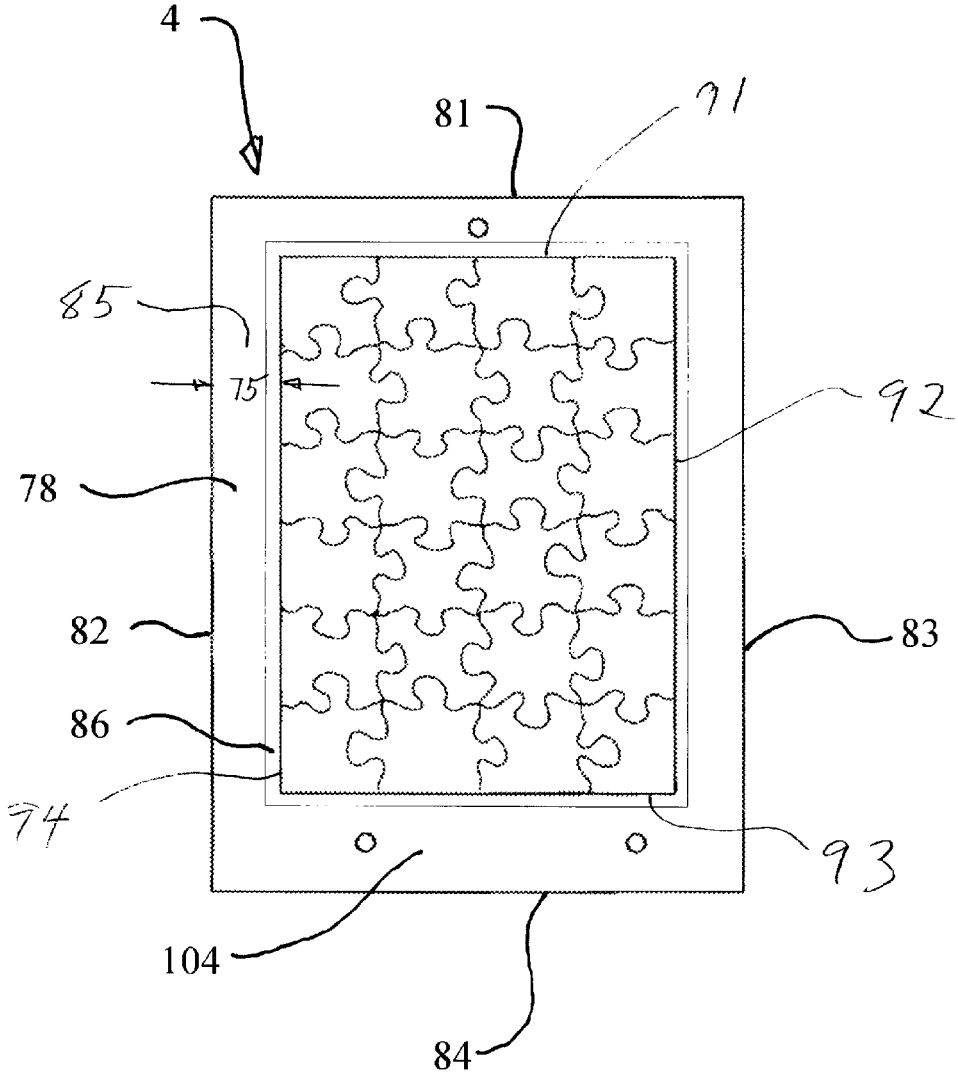
FIG. 5 is a plan view of a puzzle showing a bleed area.

The present invention introduces physical jigsaw puzzle improvements, whereby identically configured thinner Puzzle Clōnzz® jigsaw puzzles 2 can be melded onto the thicker 4 variety. This invention benefits computer users in the following synergistic way:

The present invention provides jigsaw puzzles that can be imprinted under one's own roof. Said puzzles are a "stand alone" product, available for use with newly developed straight path printers accepting thicker digital media for imprinting.

As in FIGS. 1 and 1A, the present invention provides thick jigsaw puzzles 4, in a range of 0.020" to 0.090". At the time of this application's provisional application, we preferred a thickness 6 of 0.030".

But after further experimentation we now prefer a presently preferred thickness 6 of 0.050", which 0.050 puzzles 4 are five times heavier (thicker), than the optimal thickness taught by Krisch's earlier specification: (0.010") thick 8 jigsaw puzzles 2 (FIG. 1A) which 0.010" is basically the thickness of a normal business card.

Presently, thickness 6 of puzzle 4 is limited by the thickness limitations of the manufactured printers. This is expected to increase as printers advance.

The 0.090" limitation is dictated by the users' ability to separate die-cut puzzle pieces of very thick cardboard, which becomes difficult above 0.090 inches.

In one embodiment of the present invention, cardboard puzzles 4 are lined/mounted (glued), both top 10 and bottom 11, with an ink-jet printable surface such as a high quality, high brightness white, ink-jet compatible paper 14-15. Krisch's previously preferred embodiment 2 was composed of cast coated on one side 16, non-porous, non-absorbent, solid white card stock 18.

We envision embodiments having other surface materials than paper or cardboard, as such other materials become available with ink-jet printable surfaces.

As in the previous Krisch embodiment, both sides 10-11, of the jigsaw puzzle's 4 substrate 20 can be imprinted, to create and implement dual sided 10-11 puzzle projects.

Children can comfortably conjoin 0.030" thick jigsaw puzzles 4 of the present invention. Said puzzles afford the appropriate thickness 6, in and of themselves, to give a child the feeling of an interlocking sensation, when they place one interlock 21-22 into it's corresponding piece . . . thereby assisting them with the development of their motor coordination and manual dexterity abilities.

Where a thick-substrate printer is unavailable to a user, the earlier Krisch thin (approximately 0.010") substrate 2 can be printed on by a conventional curved path printer. By package 30 coding 32 (FIG. 3), and by the coordination of strategically located registration pin holes 41-43, 47-49 (FIG. 1) and pins 45 (FIG. 4), thick puzzles 4 and correspondingly compatible thin puzzles 2 may be pasted or glued together. Both thin jigsaw puzzles 2 and thick jigsaw puzzles 4 are identically configured and can permanently adhere to one another through a gluing application.

Figure 7:
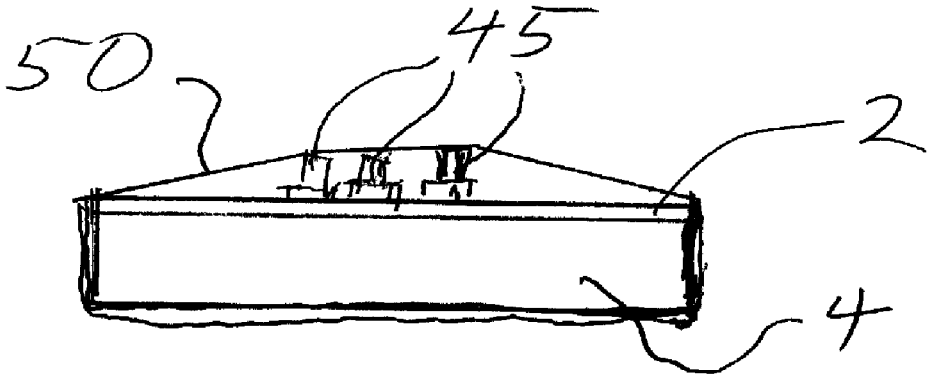
FIG. 7 is a front elevation of a thick and a thin puzzle in one shrink wrap package.

One distribution embodiment is in FIG. 7, a front elevation of a thin puzzle 2 and a thick puzzle 4 in one shrink wrapped package 50, which includes registration pins 45.

Figure 8:
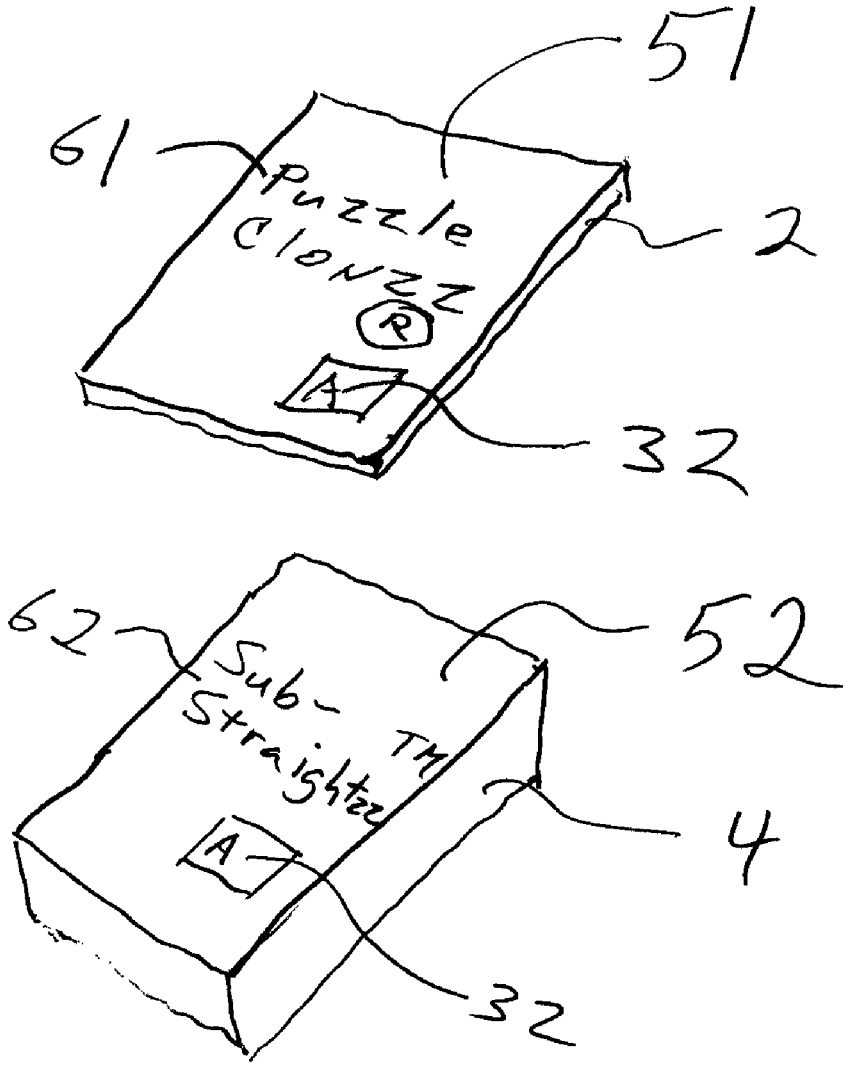
FIG. 8 is an oblique view of two compatible thin and thick puzzles in separate coded packages.

An alternate embodiment, with a novel business method, is shown in FIG. 8, an oblique view of two compatible puzzles: thin puzzle 2 and thick puzzle 4 in separated coded packages 51-52. Each compatible package bears the same human readable code 32, enabling buyers to determine which thin puzzles 2 are compatible with which thick puzzles 4.

In either distribution scheme, the package or packages may contain several puzzles.

A novel business method is provided where thin puzzles 2 and thick puzzles 4 are given different coordinated brand names. The thin puzzles 2 have already achieved secondary meaning under the trademark Puzzle Clonzz® 61. The business method calls for coordinated advertising to promote a compatible trademark such as: Sub-Straightzz™ 62, to designate the thick puzzle 4 of the present disclosure.

Our strategically placed, frame-hole 41-43 and 47-49 pin 45 registration system assures perfect piece alignment, during the adherence process, of the jigsaw puzzle of one brand to the other brand . . . in every instance from Puzzle Clonzz®, to Sub-Straightzz™.

Said frame-hole registration system, comprises three strategically placed quarter-inch (0.25") diameter holes 41-43 and 47-49 punched into every frame . . . one hole 41 and 47 at each feed end 65, 66 of the puzzles, during the printing process, and two holes 42-43 and 48-49 in the trailing border 104 of the puzzle, once imprinted.

Figure 6:
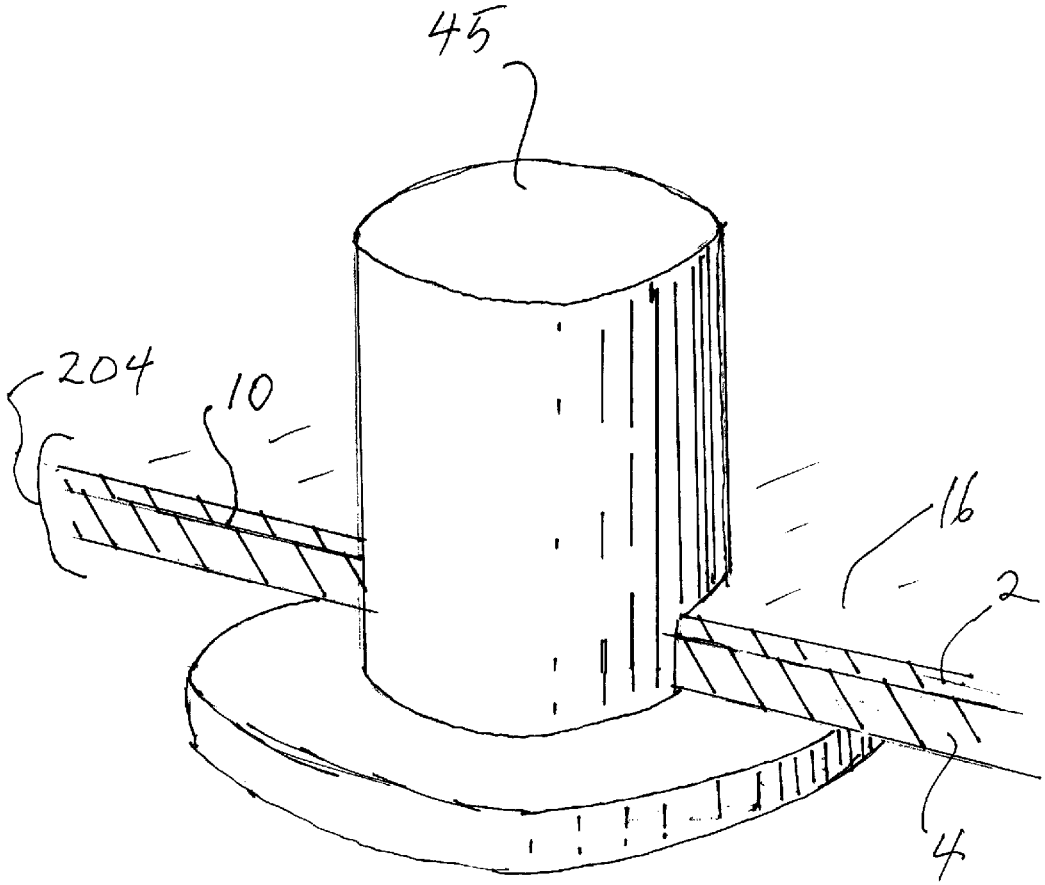
FIG. 6 is an oblique view showing a registration pin, not in section, on which two puzzles, shown in section, are registered.

Accompanying the puzzles 2, 4 are three (3) quarter-inch (0.25") metal pins 45 (FIG. 4), upon which the thick "Sub-Straightzz" jigsaw puzzle 4 must be placed (impaled) FIG. 6. Once positioned, brush or spray a glue adhesive onto the thicker Sub-Straightzz surface 10 (FIG. 1A), including the entire frame 78 (FIG. 1). Then place the imprinted thinner card Puzzle Clonzz® puzzle 2 onto the pins, one hole upon another, the bottom of puzzle 2 to the top of puzzle 4, as shown in FIGS. 2 and 6. Press the puzzles together and completely flatten the surface . . . then wait for them to dry (a function of the adhesive administered) before disassembling the pieces.

As in FIG. 1, there are frames 77 and 78 around the both puzzles 2 & 4, represented in FIG. 5 by puzzle 4:

0.75" from the feed end 81 to puzzle edge 91, 0.75" from card edges 82-83 to puzzle sides 92 and 94, and 1.25" from the card trailing edge 84 to puzzle trailing edge 93, because most printers will not allow for imprinting on the first 0.5" from all edges 65, 192-194 and 81-84 of FIG. 1.

As shown in FIG. 5, our 0.75" borders 85 provide additional clearance on all edges for the user to print a true "bleed" 86, where desired. A bleed 86 functions as a waste area, permitting one to actually print an image off all four sides 91-94 of the puzzle 4, so as not to see any white edges in the finished puzzle product, once removed from the frame 78. This also applies to the thin puzzle 2, not shown in FIG. 5.

The frames 77, 78 (FIG. 1) also provide a bottom border 104 of the puzzles 2 & 4, which bottom border 104 measures 1.25". This waste area 104 may appear to be unnecessarily wide. However, that border 104 protects the integrity of the final rows of pixels, actually laid down by a printer. In most instances, any attempt to print beyond the trailing edge 194 or 84 of a sheet, would destroy the appearance of that entire sheet (by providing lines of crooked type and/or misaligned pixels) . . . due to slippage, a phenomenon evidenced by a printer's inability to continually control the feed of the sheet during the printing function. You can prove that fact on your own printer by attempting to print off the bottom of an 8.5"× 11" letter-sized sheet, using an 8.5"×14" legal-sized paper setting. That very same 1.25" selvage edge 104 permits a printer to steadily control slippage on every puzzle 2,4, since the ejection rollers remain in full contact with the traversing boards 2 & 4, through the finalization of the ink affixing process.

When the puzzle assembly 204 (FIG. 2) is ready to be dismantled, the user gently removes the frame border 77 or 78 of FIG. 1, and disposes of the frame border in the trash since it no longer functions in any relevant way to the use of the final jigsaw puzzle product.

We claim:

1. A precut jigsaw puzzle, having:

a blank and printable face;

a thick substrate;

said thick substrate forming a thick substrate sheet;

said thick substrate sheet being pre die-cut by a plurality of cuts, into a plurality of thick puzzle pieces;

said thick puzzle pieces joined together by uncut lands between said thick puzzle pieces;

said cuts and said lands in such proportions as to allow users to separate the thick puzzle pieces from each other;

said thick substrate having a thickness of at least 0.020", and less than 0.090";

a thin (approximately 0.010") substrate, forming a thin sheet;

said thin sheet having die cuts, which thin sheet cuts are identically configured by the die to precisely correspond to the cuts of the thick substrate sheet;

which die cut thin sheet can be printed on by a curved path printer, so that both the die cut thin sheet and the thick substrate sheet are identically configured and can permanently adhere to one another through a gluing application;

three strategically located registration pin holes on both the thin sheet and the thick substrate sheet;

three registration pins;

whereby both the thin sheet and the thick substrate sheet are located on the three registration pins, with the respective cuts, of the thin sheet and the thick substrate sheet, correspondingly lined-up to each other, so that the thin pieces are glued together to their corresponding thick puzzle pieces, forming a laminated sheet, and each thick puzzle piece of the thick substrate will remain attached to its corresponding thin piece of the thin substrate, to form a laminated piece, collectively forming a plurality of laminated pieces, which said laminated pieces may be separated from each other, by bending the laminated sheet along the aligned: cuts and thin sheet cuts, to break the lands, whereby each puzzle piece is separated from each other puzzle piece, to form a plurality of separated laminated pieces.

2. A plurality of pre-cut jigsaw puzzles according to claim 1, each pre-cut jigsaw puzzle, of the plurality of pre-cut jigsaw puzzles, having a different configuration, each configuration, of the plurality of different configurations, having its own corresponding package code, readable by a human, which package code is located with both each thick substrate sheet having said configuration, and each thin sheet having said configuration, whereby thick substrate sheets may be sold separately from corresponding thin sheets, but each thick substrate sheet may be matched, by users who can't print on thick substrates, with the corresponding thin sheet of the same configuration, prior to purchase;

enabling buyers to thereby determine which thin sheets are compatible with which thick substrate sheets, to form a laminated puzzle.

3. A plurality of pre-cut jigsaw puzzles according to claim 1, in which the thin sheet is packaged in a same package with a thick substrate sheet, having the same configuration, and said package includes registration pins.

* * * * *